US007707921B1

(12) United States Patent
Hoel

(10) Patent No.: US 7,707,921 B1
(45) Date of Patent: May 4, 2010

(54) AMBIDEXTROUS CHARGING HANDLE FOR FIREARM

(76) Inventor: Thomas Trail Hoel, P.O. Box 234, Golden, CO (US) 80402-0234

( * ) Notice: Subject to any disclaimer, the term of this patent is extended or adjusted under 35 U.S.C. 154(b) by 0 days.

(21) Appl. No.: 12/287,173

(22) Filed: Oct. 7, 2008

(51) Int. Cl.
*F41A 7/02* (2006.01)

(52) U.S. Cl. ..... 89/1.4; 42/16

(58) Field of Classification Search ..... 89/1.4, 89/179, 191.01, 191.02, 192; 42/16, 69.01, 42/69.02

See application file for complete search history.

(56) References Cited

U.S. PATENT DOCUMENTS

| | | | | |
|---|---|---|---|---|
| 3,225,653 | A | 12/1965 | Packard | |
| 5,551,179 | A * | 9/1996 | Young | 42/16 |
| 6,311,603 | B1 * | 11/2001 | Dunlap | 89/1.4 |
| 7,231,861 | B1 * | 6/2007 | Gauny et al. | 89/1.4 |
| 7,240,600 | B1 * | 7/2007 | Bordson | 89/1.4 |
| 7,444,775 | B1 * | 11/2008 | Schuetz | 42/76.01 |

FOREIGN PATENT DOCUMENTS

| | | |
|---|---|---|
| WO | WO 2007/090611 A1 | 8/2007 |

* cited by examiner

*Primary Examiner*—Michael Carone
*Assistant Examiner*—Gabriel J Klein
(74) *Attorney, Agent, or Firm*—James R. Eley; Michael A. Forhan; Eley Law Firm Co.

(57) ABSTRACT

An ambidextrous charging handle for a Stoner-type firearm. The charging handle comprises two separate assemblies, these being an oblong handle that contains a latch assembly and a central shaft member. The parts are joined together by a compound pivoting arrangement in which a combination of the latch assembly and alignment grooves in the central shaft member interacting with slidingly engage a locating flange on the oblong handle, and a pair of pivoting connectors that secure the latch assembly to the oblong handle and the central shaft member independently from one another. The latch assembly includes cam activation via a retention relief cut acting against a fixed minor pivot connector. The second point of retention for the assembly is via a major pivoting connector the combination of which transmits the retraction force applied to the oblong handle on one end of the latch assembly and to the central shaft member through the interconnection of the minor pivot connector located at the proximal end of the latch body.

11 Claims, 5 Drawing Sheets

AMBIDEXTROUS CHARGING HANDLE FOR FIREARM

BACKGROUND OF THE INVENTION

1. Field of the Invention

This application relates broadly to ambidextrous charging handles for firearms. More particularly, it concerns an improved form of an ambidextrous charging handle for military and semi-automatic firearms, particularly the Stoner-type firearm systems including the AR-10, AR-15, M16, M4 series and all subsequent AR-10 type, AR-15 type, M16 type, M4 type firearms, their clones, and derivatives.

2. Description of the Prior Art

Charging handles for this type of firearm system have been described since the very first version of Eugene Stoner's original firearm design universally first known as the AR-15 type rifle, and later adopted by various militaries as the "M16" series.

There were several iterations of the basic charging handle designed, tested, and proposed for military adoption, and later on for commercial sales. The earliest Stoner-inspired design had a semi-triangular shape where the base of the triangle form was the rear face of the handle and the other two sides were alternately formed on the right by an extension of the base, and on the left side by the receiver retaining latch itself. When activated, the operator was required to simultaneously grasp the right side face of the handle while also grasping and restraining the left side latch and retracting the entire charging handle assembly in order to charge the firearm. Rearward pressure was intended to be applied only upon the two "forward" sides of the triangle form. The irregular geometric shape of this early design when grasped to open the latch, combined with the physically small triangular surfaces available made rapid or off-side charging of the firearm extremely difficult, if not entirely impossible under certain operational conditions.

It has been recognized then, since the very earliest stages of development of this firearm system, that rapid, effective, charging of the firearm is largely dependant upon the available dexterous grasping surfaces of the charging handle and the ability of the operator to grasp and manually depress/squeeze the receiver retaining latch prior to withdrawing the handle assembly. The entire series of these charging handles in the art was designed solely around right-handed operators and has never been easy, sure, or efficient for left-handed operators to function, or even right-handed operators using the handle in the off-side, or slung positions.

When it was realized that the original triangular plan form was inefficient and difficult to use the charging handle's external grasping surface shape was redesigned. The resulting finalized compromise shape was described as being approximately in the shape of a capital letter "T" form, with the transverse member of the "T" acting now as the grasping handle. Rather than pulling exclusively on the heavily slanted sides of the triangular form as with the original design, the operator now was trained to grasp both the front and rear surfaces of the left side of the transverse member between the forefinger and thumb. With this grip, this meant that the left side receiver retention latch had to be squeezed before the charging handle could be retracted to cock or charge the firearm. In this basic form the charging handle assembly has been standardized, adopted for service use and commercial sale, and has remained essentially unchanged since the early 1960's. This basic form is still the standard issue form for all service and commercial variations of this family of firearms. Despite the standardization of this later design, little has been done in the ensuing years to improve upon the inherent problems and defects of effective grasping of the less than ideal shape of the handle, combined with the need to manually function the left side receiver retention latch, exclusively. This was already a significant enough difficulty for right-handed operators of the firearm system but when left handed or even off-side charging was contemplated, the tactile problems become nearly insurmountable, thus contributing significantly to the operator's loss of effectiveness or rapidity in charging the firearm, especially under immediate action requirements, such as during military combat or police enforcement operations. As understood in the art, under such critical circumstances it may be vital to keep one's finger on the trigger for self-defensive purposes while recharging the weapon with the opposing hand.

Several attempts have been made to resolve this problem of charging such firearm systems by the provision of ambidextrous charging handles. U.S. Pat. Nos. 3,225,653 (Packard), 7,240,600 (Bordson) and WIPO application WO2007/090611 (Fluhr, et al.) all disclose prior art versions of ambidextrous charging handles. However, in all of these charging handles multiple separate latch grasping surfaces are used. Packard required both latches to be grasped and squeezed simultaneously to allow operation of the charging handle. Bordson and Fluhr, et al. requires either one or both of the latches to be grasped and squeezed to allow operation of the charging handle. What is needed instead is a charging handle that allows for truly ambidextrous operation from either side of the charging handle while at the same time allowing for efficient operation from any available angle or contact point so long as a simple straight line retraction can be made, and at the same time eliminating the requirement to depress a separate latch before commencing the firearm charging operation.

Objects

The present invention solves this issue by providing a charging handle that allows for use by either a right or left handed operator. This is achieved by using an oblong handle that is a separate part, a central shaft member that is attached to the oblong handle, and a latch mechanism that is positioned in the oblong handle and mechanically interconnected.

A principal object of the invention is to provide the operator with an ambidextrous charging handle for military and semi-automatic firearms, particularly the Stoner-type family of firearm systems including the AR-10, AR-15, M16, M4 series and all AR-10 type, AR-15 type, M16 type, M4 type firearms, their clones, and derivatives. The present ambidextrous charging handle design achieves this object through the use of two separate assemblies, these being an oblong handle that contains a latch assembly and a central shaft member, the parts being indirectly joined together by a compound pivoting arrangement created by the combination of the latch assembly and alignment grooves in the central shaft member interacting with a locating flange on the handle, and a pair of retaining and pivoting connectors cooperating with a pivoting latch assembly that pivotably couples the latch assembly to the handle and the latch assembly to the central shaft member, independently from one another but yet linked together by the latch assembly.

A further object is to provide an ambidextrous charging handle that allows for the operator to simply grasp and pull the charging handle rearward without requiring manual actuation of a separate latch release mechanism. This is achieved by the disclosed embodiment through the use of a latch mechanism that includes cam activation via a retention relief cut acting against a fixed retention and pivot connector.

This provides not only the second point of retention for the assembly via this second retaining connector, but also acts as the means by which the latch is urged to disengage the firearm receiver prior to the time that the handle transmits rearward driving force to the central shaft member to retract the bolt or bolt carrier. This connector transmits the retraction force applied to the handle on one end of the latch and to the central shaft member through the interconnection of this second combination retention and pivot connector on the proximal end of the latch body.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements of known military and semi-automatic firearms, particularly the Stoner-type family of firearm systems including the AR-10, AR-15, M16, M4 series and all subsequent AR-10 type, AR-15 type, M16 type, M4 type firearm, their clones, and derivatives that comprise:

(a) an ambidextrous charging handle that allows for use by either a right or left handed operator, this being achieved by using a multiple part charging handle that comprises an oblong handle that is a separate part, a central shaft member, and a latch mechanism that is positioned within the oblong handle and pivotably coupled independently with the other two.

(b) an ambidextrous charging handle that allows for the operator to simply grasp and pull the charging handle rearward without having to grasp and squeeze a separate latch mechanism to operate the charging handle.

A first unique improvement provided by the invention is an ambidextrous charging handle assembly that consists of only two main parts, the central shaft and the handle assembly, with the latch mechanism being part of the handle assembly.

A second unique improvement is to provide an ambidextrous charging handle that may be used without any separate manual operation of the latch mechanism. This is achieved through the use of the latch mechanism being activated by the simple act of pulling the handle in a rearward motion, and the previous method of initially and separately squeezing the latch is no longer necessary or required.

A third unique improvement is the provision of an ambidextrous charging handle that uses cam activation of the latch mechanism to eliminate the manual squeezing of the latch. This is achieved through the use of two separate connector points. These provide firstly a combined firearm receiver retention and pivot function to the latch and the central shaft and secondly, another combined retention and pivot function to the latch that also interfaces with a relief cut in the latch, thus providing a camming activation, retention and pivot function with respect to the grasping handle. This combination of retention and pivot connectors allows the rearward movement of the handle assembly to initially transmit the retraction force to the latch, opening the latch just prior to the time that the rearward force applied to the central shaft results in retraction of the firearm's bolt carrier and/or bolt. This is achieved through the interaction between the second retention and pivot function and the relief cut in the latch that converts the retraction motion of the connector into a lateral movement of the latch body in a calculated angular translation of motion.

A fourth unique improvement is the provision of an ambidextrous charging handle that provides for an improved tactile gripping surface, allowing the user to grip or grasp the charging handle more positively though the addition of tactile serrations, raised or lowered edges, ridges, bumps or flanges to the handle assembly.

BRIEF DESCRIPTION OF THE DRAWINGS

A more complete understanding of the invention can be obtained by reference to the accompanying drawings wherein the specific parts are indicated by plain lines and wherein.

DESCRIPTION OF PREFERRED EMBODIMENTS

Figure 1:
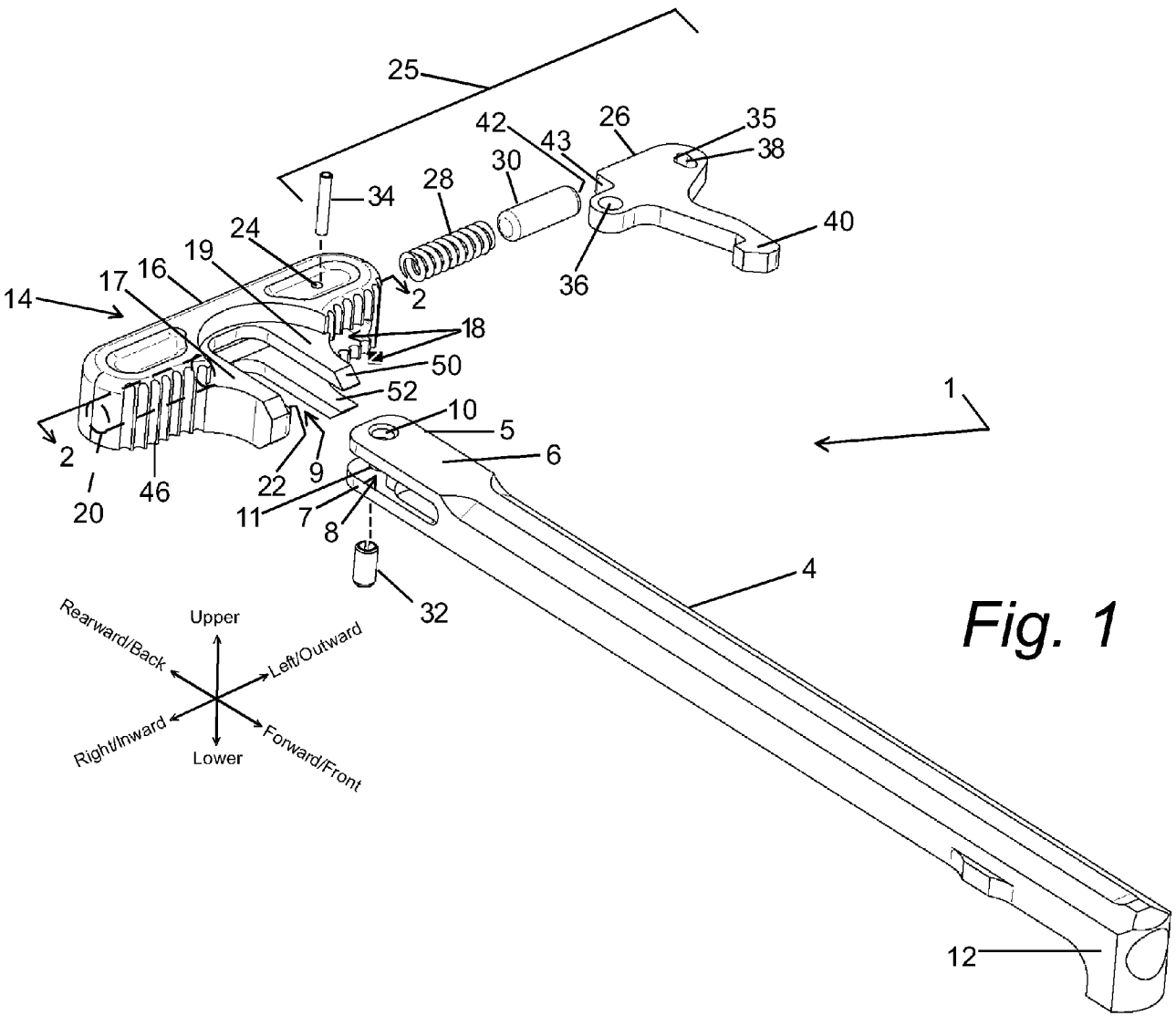
FIG. 1 is an isometric exploded view of the ambidextrous charging handle according to an embodiment of the present disclosure.
Figure 2:
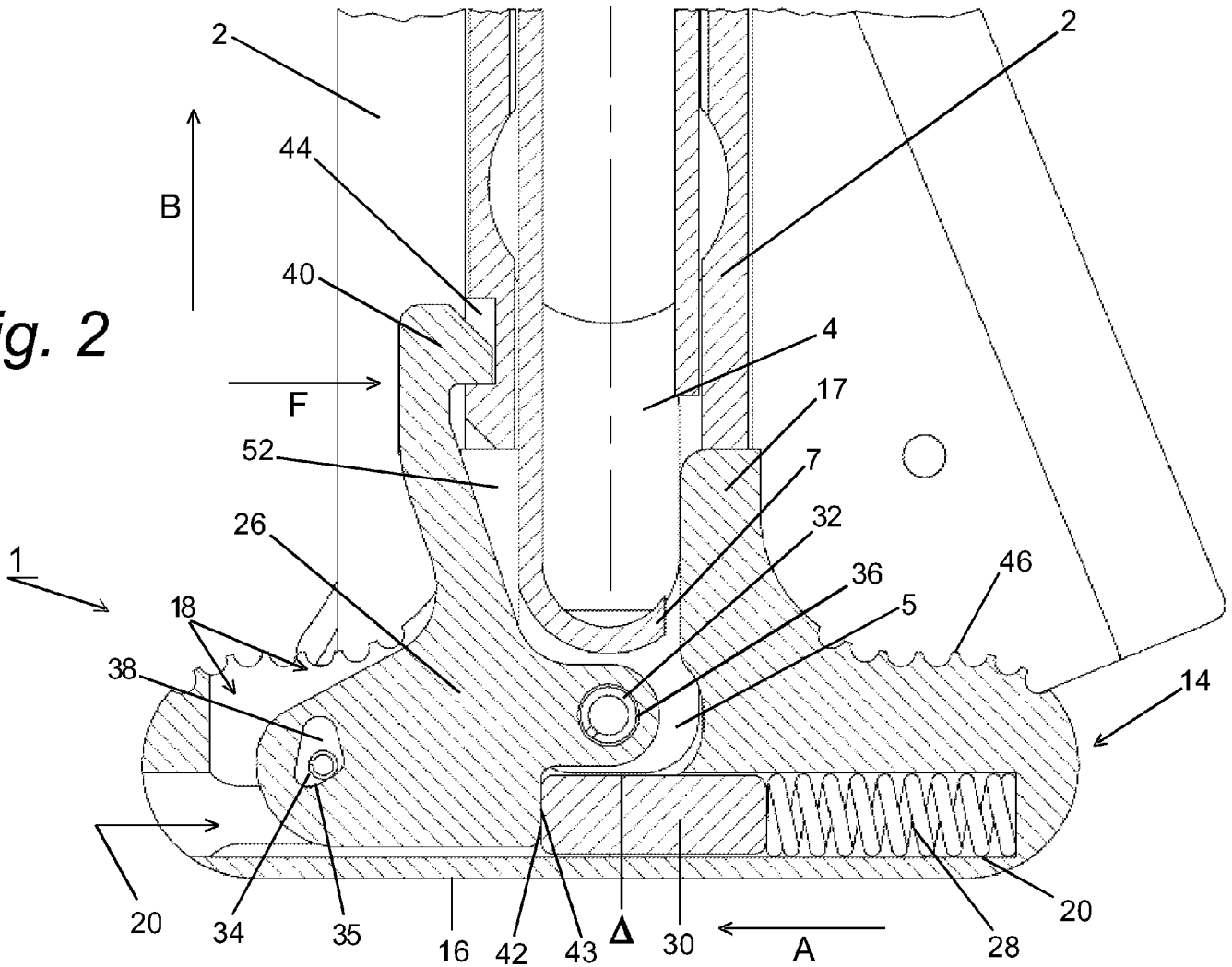
FIG. 2 is a sectional plan view of the ambidextrous charging handle of FIG. 1 taken through Section 2-2 with the charging handle fitted to a firearm and showing the charging handle in a closed, locked position.

Referring in detail to FIG. 1 an ambidextrous charging handle 1 consists of central shaft 4, oblong handle 14, and latch assembly 25 that consists of latch 26, spring 28, biasing pin 30, and major and minor pivot connectors 32, 34. The central shaft 4 comprises an elongated portion terminating in body 6 having a transverse horizontal slot 8 machined through the body at the proximal end of the central shaft to form upper and lower tangs 5, 7. At the proximal end of the central shaft a vertical bore hole 10 is located through both upper and lower tangs 5, 7 of the body 6. At a distal end of the central shaft 4 a bolt hook is provided to engage a bolt carrier (not shown) located within upper receiver 2, as seen in FIG. 2. The oblong handle 14 has a cross bar section 16, a horizontal slot 18 machined partially therethrough and a cylindrical bore recess 20 that extends horizontally through the left hand side of the oblong handle and terminates within the right hand side of the oblong handle. At the distal end of the oblong handle 14, a longitudinal slot 9 terminating in an arcuate cut-out and right and left extensions 17, 19 extends rearward into the oblong handle and includes a locating flange 22 or rail portion on the right inner surface of cross bar section 16, extending partially into the longitudinal slot. The locating flange 22 slidingly engages the right side of the transverse horizontal slot 8 in the central shaft 4. Once the proximal end of body 6 is seated within longitudinal slot 9 and abuts cross bar section 16, major pivot connector 32 is installed and secures latch 26 to the central shaft 4 through vertical bore hole 10 and pivot hole 36 which is sized larger than the diameter of the retaining connector so the latch remains free to slide within oblong handle 14. Horizontal slot 18 is positioned parallel to the horizontal surface of the oblong handle 14 and extends inward to the cylindrical bore recess 20 from the distal surface of the oblong handle 14. The horizontal slot 18 extends from the left hand side of the oblong handle 14 through upper and lower fingers 50, 52 and terminates at a position slightly past the median point of the oblong handle. A vertical bore hole 24 is located on the left hand side of the oblong handle 14 and extends from the top to the bottom portions of the oblong handle through horizontal slot 18. The oblong handle 14 may be provided with a plurality of ribs, grooves, bumps or tactile serrations 46 to provide a tactile gripping surface when the ambidextrous charging handle 1 is actuated by the operator. Although shown with vertical serrations, as at 46, it would be obvious to someone skilled in the art to change or replace such serrations in a plurality of ways to enhance the grasping capability.

The latch assembly 25 consists of latch 26, a spring 28, biasing pin 30, major pivot connector 32 and minor pivot connector 34. Latch 26 is fitted with pivot hole 36 near its inner portion, cam/retention cut pivot hole 38 fitted near the outer portion of the latch. Latch hook 40 is located at the forward-most, distal end of the latch. At the rearward, proximal end of the latch, latch bearing surface 43 is provided for surface engagement with contact surface 42 of biasing pin 30.

Assembly of the ambidextrous charging handle is achieved by fitting spring 28 and biasing pin 30 into the cylindrical recess 20. While shown as discrete elements, spring 28 and biasing pin 30 may be substituted with other suitable return mechanisms. Latch 26 is fitted into the oblong handle 14 through the front of horizontal slot 18 with latch bearing surface 43 bearing against contact surface 42 of spring urged biasing pin 30. With horizontal pressure being applied in a rightward bearing direction to the latch 26, the minor pivot connector 34 is then press fitted through the vertical bore hole 24, through cam/retention cut 38 in the latch and into the corresponding bore hole portion (not shown) located on the bottom of oblong handle 14. Central shaft 4 is then slidingly fitted into longitudinal slot 9 of oblong handle 14 with locating flange 22 engaging the right side of transverse horizontal slot 8 and a right portion of latch 26 containing vertical bore hole 36 engaging the left side of the transverse horizontal slot. Latch hook 40 is sized to captively engage a receiver retaining notch 44 (as seen in FIG. 2 et al.) located on the left hand side of firearm receiver 2 in a conventional manner, typical of most Stoner-type firearms. Major pivot connector 32 is then press fitted through vertical bore hole 10 through upper tang 5 of body 6 and pivot hole 36 of latch 26 and then into a corresponding lower bore hole 11 located in lower tang 7 of the body to complete assembly of ambidextrous charging handle 1.

Note that according to this description of the embodiment of the disclosure oblong handle 14 is never connected directly to central shaft 4 of ambidextrous charging handle 1 but rather, it is indirectly coupled via a compound pivoting arrangement through major pivot connector 32 and minor pivot connector 34 interconnected through latch 26 via vertical bore holes 10 and 24.

Now referring to FIG. 2 the position of the ambidextrous charging handle 1 is shown in a closed and locked position. Latch hook 40 is shown captively engaged by receiver retaining notch 44 located on firearm receiver 2. Biasing pin 30 and biasing spring 28 are shown in a compressed biasing position and contact surface 42 of biasing pin 30 is bears against bearing surface 43 of latch 26. This provides a constant outward pressure against latch bearing surface 43 and against the combination of the cam/retention cut 38 and the minor pivot pin 34 positioned within the cam/retention cut thereby urging latch hook 40 to remain engaged with receiver retaining notch 44 and deterring the unintentional release and retraction of charging handle 1. This outward biasing force is depicted in FIG. 2 by the arrow labeled "A".

Figure 3:
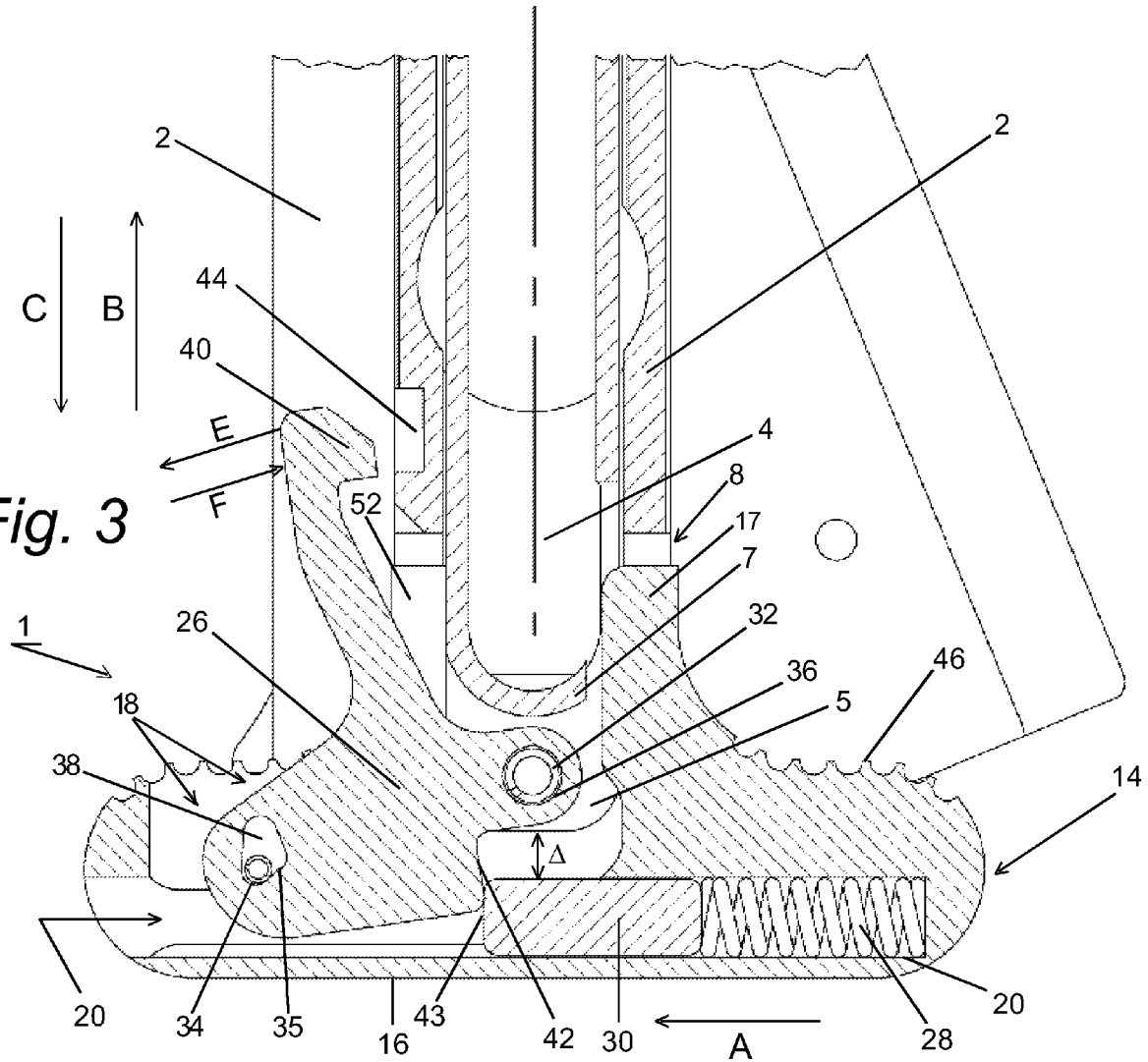
FIG. 3 is a sectional plan view of the ambidextrous charging handle of FIG. 1 taken through Section 2-2 showing the charging handle in an open, unlocked position.

Moving additionally to FIG. 3 the position of the ambidextrous charging handle 1 is depicted in the first stage of opening. Unlike latched charging handles in the present art that require manual actuation of a latch release button, the embodiment of the present disclose does not. In sharp contrast to the art, the present disclosure describes an ambidextrous charging handle 1 that can be activated by applying rearward pressure to any portion of the oblong charging handle 14. As is commonly known by those familiar in the art, there is a bias applied by an action spring 60 housed within the stock 62 of the firearm (shown in FIG. 5) to resist the retraction of charging handle 1. This force is depicted in the FIGS. 3 and 4 by arrow "B" and is provided to urge charging handle 1 to remain in its forwardmost, closed condition as in FIG. 2. By applying a countering, rearward force on the oblong handle 14 in the direction shown by arrow "C" the oblong handle 14 portion of charging handle begins to withdraw from receiver 2. As that happens, latch hook 40 disengages retaining notch 44 in receiver 2 thus allowing the oblong handle portion 14 of the charging handle 1 to be further retracted from the receiver. Since oblong handle 14 is connected to central shaft 4 through a compound pivoting arrangement formed by major and minor pivot connectors 32, 34, oblong handle and central shaft initially retract at different rates. This initial offset in retracting rates can be seen in FIGS. 3 and 4 at the arrow labeled "Δ". Once the retraction force "C" exceeds that of forward biasing force "B" and the "A" is at or nearing its mechanical limit imposed by minor pivot connector 34 central shaft 4 starts to retract with the rest of the charging handle and thereby drawing the firearm's bolt carrier (not shown) and/or bolt (not shown) in a rearward direction. This is achieved by the bolt hook 12 (as shown in FIG. 1) engaging the bolt carrier and/or bolt in the receiver of the firearm. The rearward motion of the oblong handle 14 is translated into movement of the latch hook 40 through the combination of cam/retention cut 38, and minor pivot connector 34. The cam/retention cut 38 of the latch 26 activated by the rearward motion of the oblong handle 14, forcing the proximal end of the latch to be cammed slightly left and slightly rearward by minor pivot connector 34 sliding across camming surface 35 (in the direction depicted by arrow "E") and at the same time moving the distal end of the latch and the latch hook 40 in a lateral direction as shown by arrow "F" away from the central shaft 4. The latch 26 pivots in a lateral outward direction at the same time due to the major pivot connector 32 allowing the latch 26 to pivot around the axis of the major pivot connector 32. The camming angles in the cam/retention cut 38 are designed to ensure that the angular movement of latch 26 and the latch hook 40 is sufficient to clear the recess or receiver retention notch 44 in the firearm's receiver 2 before transmitting rearward force (arrow "C") to the central shaft 4.

Figure 4:
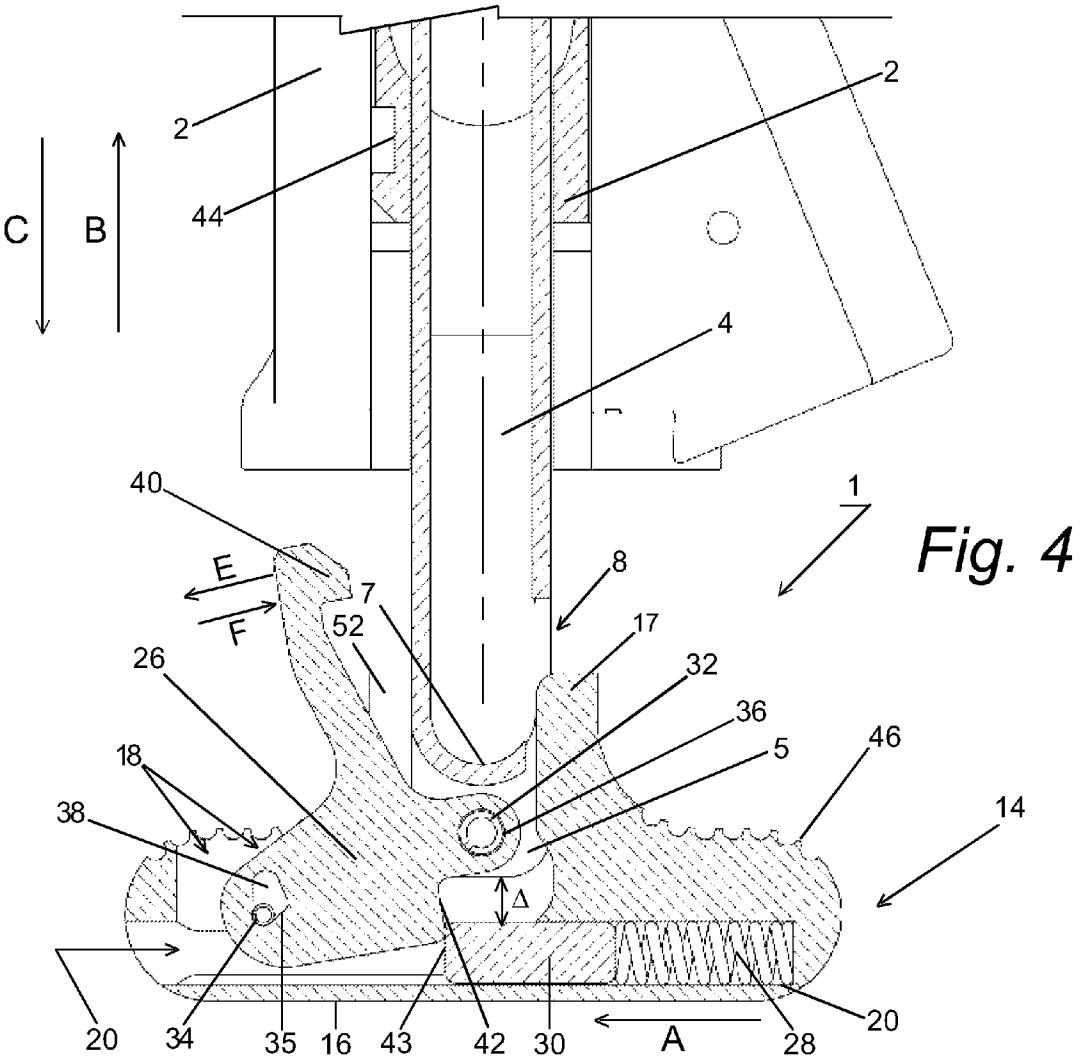
FIG. 4 is a sectional plan view of the ambidextrous charging handle of FIG. 1 taken through Section 2-2 showing the charging handle in a fully opened position.
Figure 5:
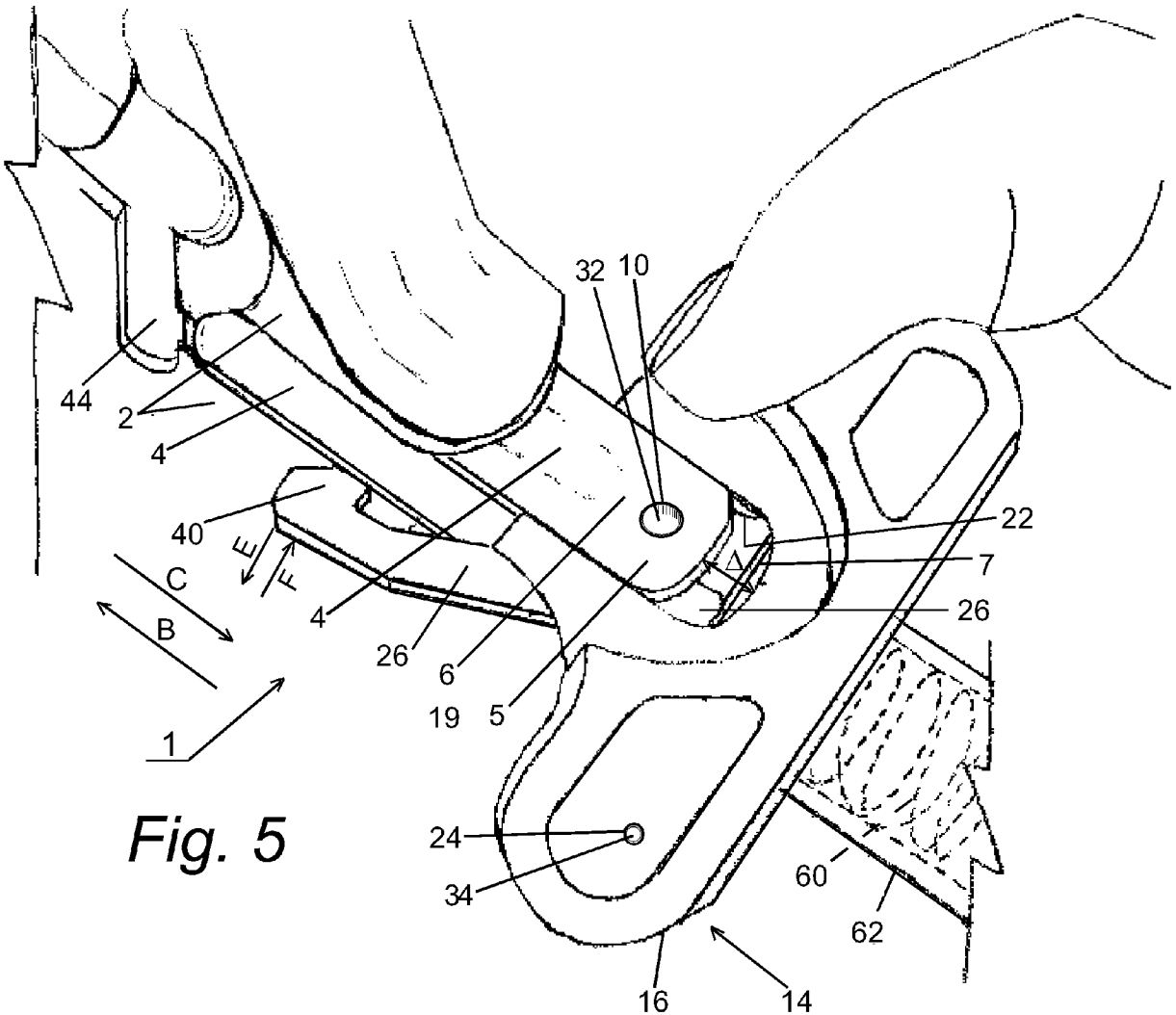
FIG. 5 is a perspective view of key elements of the ambidextrous charging handle shown in section in FIG. 4 of the present disclosure, with the charging handle being manually retracted without direct disengagement of the latching assembly.

FIGS. 4 and 5 show the position of the ambidextrous charging handle 1 in a substantially opened position. Latch hook 40 is approaching its maximum retracted position and oblong handle 14 and central shaft 4 are likewise shown approaching their respective maximum rearward positions. This rearward position corresponds with the retraction of the firearm's interior bolt carrier (not shown) and/or bolt (not shown) in a rearward position against the action spring 60 of the firearm sufficiently to cock or charge the firearm. Once the firearm is charged, the operator releases the ambidextrous charging handle 1 which is quickly urged forward by the firearm's internal action spring 60 to re-engage latch hook 40 into receiver retaining notch 44, thereby securing the charging handle until the next time it needs to be actuated.

Other alternate embodiments may be obvious to those skilled in the art and these may include provision of a charging handle that is configured to emulate the specific exterior physical dimensions and outward appearance of the extant standardized military/commercial charging handle while fully incorporating the disclosed mechanism and features. This alternate embodiment may have the familiar exterior physical traits and appearances of the standard charging handle while incorporating the disclosed mechanism. Another alternate preferred embodiment may feature alternate hardware for the fixing and locating of the pivot points.

Further alternate embodiments may also provide for additional physical features intended to provide for specific enhanced functionalities including for superior tactile gripping surfaces, and/or for enhanced mechanical strength for abusive use conditions. Such features as tactile serrations, raised or lowered edges, ridges, or bumps, or flanges may be added to certain components of the basic apparatus at deliberate locations designed to increase the utility of the full charging handle assembly. Yet another alternate embodiment may be provided with complementary integrated features designed to provide for enhanced user safety when employed with sound suppressed weapons by possessing additional to safely and effectively block, prevent, preclude, divert, contain or displace high-pressure propellant gas discharges from escaping the confines of the weapon's receiver through the clearance slots for the charging handle in the upper receiver.

While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A charging handle assembly for a firearm having a receiver, the assembly comprising:

a central shaft having a proximal end and a distal end;

an oblong handle having a cross bar section, a locating flange and a longitudinal slot for sliding engagement with the central shaft;

a latch assembly with a biasing element for urging a portion of the latch assembly to pivot in a predetermined direction;

the latch assembly further having a plurality of through pivot holes for receiving pivoting connectors and having a latch hook for captively engaging the receiver when the charging handle assembly is in a forward, closed position;

wherein the latch assembly is coupled to the central shaft with a first pivot connector, and further coupled to the oblong handle with a second pivot connector such that the central shaft is slidably movable within the oblong handle and such that the latch assembly is biased to engage the receiver, forming a charging handle assembly with the central shaft being slidably movable within the oblong handle and the latch assembly being biased to engage the portion of the receiver when the charging handle is in the closed position; and wherein the latch hook remains engaged with the receiver in the closed position until a rearward force is applied to any portion of the oblong handle causing the oblong handle to partially slide away from the central shaft and further causing the latch to pivot about the first and second pivot connectors, disengaging the latch hook from the receiver and thus enabling full rearward movement of the charging handle and the charging of the firearm.

2. The charging handle assembly of claim 1 wherein the biasing element urges the latch hook towards the receiver.

3. The charging handle assembly of claim 2 wherein the biasing element comprises a spring.

4. The charging handle assembly of claim 1 wherein a latch portion of the latch assembly is pivotally connected to the oblong handle via a through pivot hole having a camming surface.

5. The charging handle assembly of claim 1 wherein the central shaft and latch assembly and the oblong handle and latch assembly are interconnected by a plurality of pivot elements through the latch assembly forming a compound pivot arrangement.

6. The charging handle assembly of claim 1 wherein the central shaft, latch element and oblong handle are configured to fit into at least a firearm of the type commercially known as AR-10, AR-15, M-16, or M4.

7. An ambidextrous charging handle assembly for a firearm having a receiver and an action spring providing forward bias on a bolt within the receiver, the charging handle assembly comprising:

a central shaft having a proximal end and a distal end;

an oblong handle having a cross bar section, a longitudinal slot, a locating flange for sliding engagement with the central shaft, and a cavity for accepting a portion of a latch assembly;

the latch assembly comprising a latch having proximal and distal ends and at least two through pivot holes for accepting pivoting connectors, a hook portion at the distal end for engaging a notched portion of the receiver when in a closed position, a biasing element mountable within the oblong handle for urging the hook portion toward the receiver, and at least two pivoting connectors;

wherein the oblong handle and latch are pivotally connected to one another, and further wherein the latch and the central shaft are connected to one another, independent of the oblong handle, forming a charging handle mechanism having a compound pivoting arrangement;

wherein an initial rearward force on any portion of the oblong handle by an operator causes the oblong handle to partially slide away from the central shaft and causes the latch assembly to pivot about its two pivot connectors to disengage the hook portion from the receiver and enable continued rearward force to be applied by the operator to overcome the forward bias of the action spring thus enabling full retraction of the bolt and the charging of the firearm.

8. The latch assembly of claim 7 wherein the biasing element comprises at least a spring mounted within the oblong handle.

9. The latch of claim 7, wherein the portion of the latch is configured to engage receiver retaining notches as provided on the receivers of firearms generally referred to as AR-10, AR-15, M-16, or M4 firearms and their derivatives.

10. The latch of claim 7 wherein at least one of the through pivot holes is provided with at least one camming surface for assisting in the activation of the latch assembly.

11. A charging handle assembly for a firearm having a receiver and internal action spring providing forward bias for a bolt carrier or a bolt, comprising:

(a) a central shaft having a proximal end and a distal end, the central shaft having a transverse horizontal slot and a vertical bore hole located at the proximal end, and a bolt hook at the distal end for engagement with the firearm's bolt carrier or bolt;

(b) an oblong handle having a cross bar section, a distal end and a proximal end, a horizontal slot, a cylindrical recess, and a locating flange positioned at the distal end of the oblong handle;

(c) a latch assembly having a latch portion with proximal and distal ends, the latch portion having at least two through holes for engaging pivot connectors and wherein at least one through pivot hole is provided with a cam/retention cut out, a latch hook located on the distal end of the latch portion, a biasing element for urging the latch hook in a predetermined direction, a minor pivot connector, and a major pivot connector;

(d) wherein the latch assembly is positioned within the horizontal slot and cylindrical recess of the oblong handle, the latch assembly being coupled to the oblong handle by the minor pivot connector positioned through the cam/retention cut out to form an oblong handle and latch assembly;

(e) wherein the oblong handle and the central shaft are slidably engaged and coupled together by the latch assembly through the major pivot connector which is press fit into the vertical bore hole at the proximal end of the central shaft, and through one of the through holes of the latch portion for captive engagement of the oblong handle and latch assembly with the central shaft thereby forming an ambidextrous charging handle;

(f) wherein the charging handle is engaged with the receiver through the latch hook when closed; and (g) wherein upon an initial rearward force being applied by an operator to any portion of the oblong handle, the oblong handle partially retracts from the central shaft causing the latch assembly to pivot about its two pivoting connectors and causing the latch hook to be urged outwardly and away from the receiver and wherein rearward movement of the charging handle overcomes the forward bias provided by the firearm's action spring, thereby enabling full retraction of the charging handle and the charging of the firearm.

* * * * *

UNITED STATES PATENT AND TRADEMARK OFFICE

CERTIFICATE OF CORRECTION

PATENT NO. : 7,707,921 B1
APPLICATION NO. : 12/287173
DATED : May 4, 2010
INVENTOR(S) : Thomas Trail Hoel It is certified that error appears in the above-identified patent and that said Letters Patent is hereby corrected as shown below:

Column 6, line 31, replace ""A"" with --"Δ"--

Signed and Sealed this

Fifteenth Day of June, 2010

David J. Kappos

David J. Kappos
*Director of the United States Patent and Trademark Office*